US009527516B2

(12) United States Patent
Nishimura et al.

(10) Patent No.: US 9,527,516 B2
(45) Date of Patent: Dec. 27, 2016

(54) RAILCAR BOGIE AND RAILCAR INCLUDING SAME

(71) Applicant: KAWASAKI JUKOGYO KABUSHIKI KAISHA, Kobe-shi, Hyogo (JP)

(72) Inventors: Takehiro Nishimura, Kobe (JP); Shunichi Nakao, Kobe (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 114 days.

(21) Appl. No.: 14/388,128

(22) PCT Filed: Jan. 10, 2013

(86) PCT No.: PCT/JP2013/000063
§ 371 (c)(1),
(2) Date: Sep. 25, 2014

(87) PCT Pub. No.: WO2013/150695
PCT Pub. Date: Oct. 10, 2013

(65) Prior Publication Data

US 2015/0047529 A1 Feb. 19, 2015

(30) Foreign Application Priority Data

Apr. 6, 2012 (JP) ..... 2012-087062

(51) Int. Cl.
*B61F 5/30* (2006.01)
*B61F 5/52* (2006.01)
(Continued)

(52) U.S. Cl.
CPC . *B61F 5/52* (2013.01); *B61F 5/30* (2013.01); *B61F 5/302* (2013.01); *B61F 5/32* (2013.01); *B61F 5/44* (2013.01)

(58) Field of Classification Search
CPC ..... B61F 3/00; B61F 3/02; B61F 5/00; B61F 5/02; B61F 5/04; B61F 5/06; B61F 5/08; B61F 5/14; B61F 5/142; B61F 5/26; B61F 5/28; B61F 5/30
(Continued)

(56) References Cited

U.S. PATENT DOCUMENTS 4,175,772 A 11/1979 Lampert
4,478,153 A 10/1984 Eggert, Jr.
(Continued)

FOREIGN PATENT DOCUMENTS

GB 2091660 A 8/1982
JP A-55-47950 4/1980
(Continued)

OTHER PUBLICATIONS

Nov. 23, 2015 Extended Search Report issued in European Patent Application No. 13773108.9.
(Continued)

*Primary Examiner* — R.J. McCarry, Jr.
(74) *Attorney, Agent, or Firm* — Oliff PLC

(57) ABSTRACT

A railcar bogie includes: a cross beam to support a carbody of a railcar; wheels at both railcar width direction sides of the bogie lined up longitudinally at each side; a pair of front and rear axles respectively at a front side and rear side in the railcar longitudinal direction to sandwich the cross beam each of the axles connect wheels located at the left side and right side of the railcar; bearings at both railcar width direction sides of each axle to rotatably support the axle; axle box portions coupled to the cross beam via elastic members to store the bearing; and plate spring portions to respectively support both railcar width direction end portions of the cross beam and both railcar longitudinal direction end portions of the plate spring portions, supported by
(Continued)

the axle box portions. The axle box portions include a surface that supports the plate spring portion.

9 Claims, 5 Drawing Sheets

(51) Int. Cl.
*B61F 5/32* (2006.01)
*B61F 5/44* (2006.01)

(58) Field of Classification Search
USPC ..... 105/157.1, 167, 171, 182.1, 199.1, 199.3,105/200–203, 218.1, 218.2
See application file for complete search history.

(56) References Cited

U.S. PATENT DOCUMENTS

| | | | | |
|---|---|---|---|---|
| 5,020,824 | A | 6/1991 | Mounier-Poulat et al. | |
| 6,338,300 | B1 | 1/2002 | Landrot | |
| 7,328,660 | B2 * | 2/2008 | Landrot | B61F 5/305 105/218.2 |
| 2005/0116436 | A1 | 6/2005 | Landrot | |

FOREIGN PATENT DOCUMENTS

| | | |
|---|---|---|
| JP | A-58-152652 | 9/1983 |
| JP | U-03-13235 | 2/1991 |
| JP | A-04-119266 | 10/1992 |
| JP | A-09-226576 | 9/1997 |
| JP | A-10-203364 | 8/1998 |
| JP | A-2002-331931 | 11/2002 |
| WO | 2011/078461 A1 | 6/2011 |

OTHER PUBLICATIONS

International Search Report issued in International Patent Application No. PCT/JP/2013/000063 dated Apr. 16, 2013.

* cited by examiner

RAILCAR BOGIE AND RAILCAR INCLUDING SAME

TECHNICAL FIELD

The present invention relates to a railcar bogie, and particularly to a railcar bogie which has a steering function and from which side sills are omitted and to a railcar including the bogie.

BACKGROUND ART

Typically, a bogie of a railcar is constituted by wheels, axles, and a bogie frame, and the bogie frame includes a cross beam extending in a railcar width direction and a pair of side sills respectively joined to both ends of the cross beam by welding or the like and extending in a front-rear direction. Axle boxes respectively accommodating bearings for supporting the axle are supported by an axlebox suspension and are configured to be displaceable in an upper-lower direction relative to the bogie frame. Problems of such a bogie are that the manufacturing cost is high due to a large number of welded portions, and the weight of the bogie is heavy. Here, PTL 1 proposes a bogie from which side sills are omitted.

Various bogies each having a steering function to improve a traveling stability of the railcar when the railcar travels along a curved line have been proposed. For example, PTL 2 proposes a steering device of a bogie of a railcar, the steering device including a steering beam, a horizontal lever, and a link.

CITATION LIST

Patent Literature

PTL 1: Japanese Laid-Open Patent Application Publication No. 55-47950

PTL 2: Japanese Laid-Open Patent Application Publication No. 10-203364

SUMMARY OF INVENTION

Technical Problem

The bogie described in PTL 1 is configured such that: plate springs are used as primary suspensions; front-rear direction middle portions of the plate springs are respectively fixed to both railcar width direction end portions of a cross beam; and both front-rear direction end portions of the plate springs are respectively inserted in spring receiving portions respectively provided at axle boxes.

However, PTL 1 regarding the bogie configured as above does not disclose the improvement of a curved line traveling performance. The steering device described in PTL 2 includes a link mechanism, and a problem is that the structure of the bogie becomes complex.

The present invention was made in consideration of these circumstances, and an object of the present invention is to provide a railcar bogie that is light in weight and has a steering function, and a railcar including the bogie.

Solution to Problem

A railcar bogie according to an aspect of the present invention includes: a cross beam configured to support a carbody of a railcar; wheels arranged at both railcar width direction sides of the bogie to be lined up in a railcar longitudinal direction at each of the sides; a pair of front and rear axles between which the cross beam is located and which are respectively arranged at a front side and rear side in the railcar longitudinal direction so as to extend in a railcar width direction, each of the axles connecting the wheels located at a left side and right side in the railcar width direction; bearings arranged at both railcar width direction sides of each of the axles and configured to rotatably support the axle; axle box portions coupled to the cross beam via elastic members and each configured to store the bearing; and plate spring portions extending in the railcar longitudinal direction so as to respectively support both railcar width direction end portions of the cross beam, both railcar longitudinal direction end portions of each of the plate spring portions being respectively supported by the axle box portions, wherein each of the axle box portions includes a supporting surface that supports the plate spring portion such that the plate spring portion is relatively movable and that is inclined toward a longitudinal direction middle portion of the plate spring portion.

According to this bogie, since the supporting surface of the axle box portion is being inclined, the railcar can be steered by increasing the wheel base at the inside rail side. With this, the curved line traveling performance can be improved by a simple configuration, and the bogie that is light in weight can be realized.

Advantageous Effects of Invention

As described above, the present invention can provide a railcar bogie that is light in weight and has a steering function, and a railcar including the bogie.

DESCRIPTION OF EMBODIMENTS

Hereinafter, embodiments will be explained in reference to the drawings. In the following explanations and drawings, the same reference signs are used for the same or corresponding components, and a repetition of the same explanation is avoided.

Embodiment 1

Figure 1:
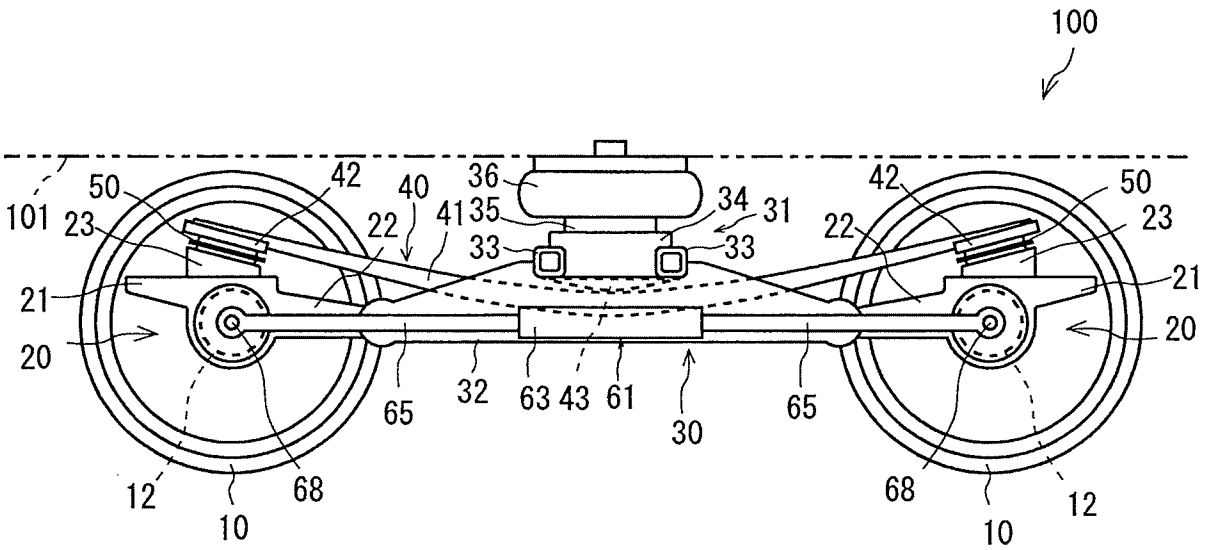
FIG. 1 is a side view of a bogie according to Embodiment 1.
Figure 2:
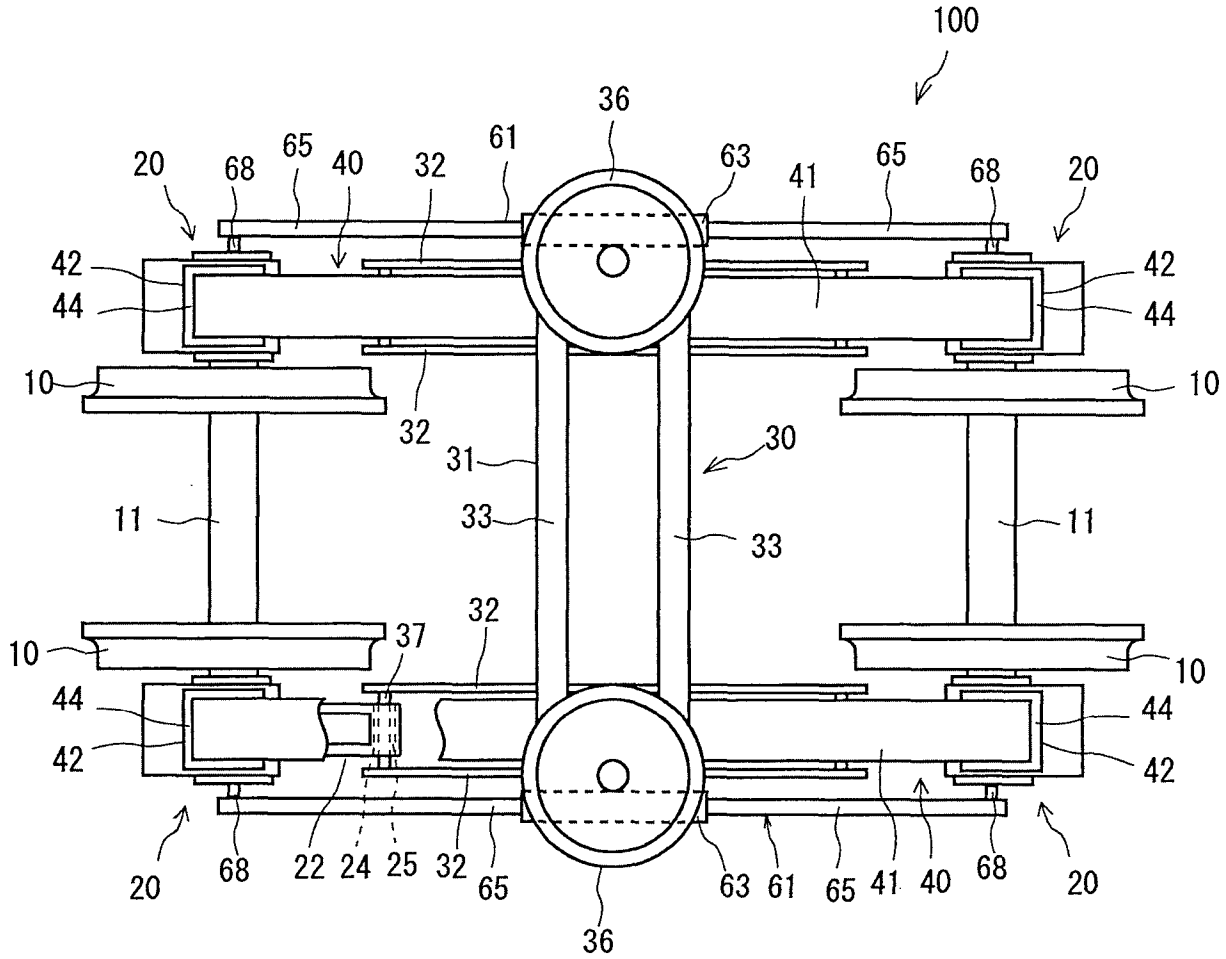
FIG. 2 is a plan view of the bogie shown in FIG. 1.

At first, a railcar bogie 100 according to Embodiment 1 will be explained in reference to FIGS. 1 to 5. FIG. 1 is a side view of a bogie 100, and FIG. 2 is a plan view of the bogie 100. FIG. 2 is a partial cutaway view in which a portion located at a lower left side on the sheet is cut away. Hereinafter, for convenience sake, explanations will be made on the basis that regarding the directions of the bogie 100, a left side, right side, near side, and far side on the sheet of FIG. 1 respectively denote a "front side", a "rear side", a "left side", and a "right side". To be specific, a front-rear direction denotes a railcar longitudinal direction, and a left-right direction denotes a railcar width direction. As shown in FIGS. 1 and 2, the bogie 100 includes wheels 10, axle box portions 20, a cross beam portion 30, plate spring portions 40, gap bodies 50, and a steering device 60. Hereinafter, these components will be explained in order.

The wheels 10 are arranged at left and right sides of the bogie 100 so as to be lined up in a front-rear direction at each side. To be specific, the wheels 10 are respectively arranged at four positions that are right front, left front, right rear, and left rear portions of the bogie 100. As shown in FIG. 2, the right front wheel 10 and the left front wheel 10 are coupled to each other by one of axles 11, and the right rear wheel 10 and the left rear wheel 10 are coupled to each other by the other axle 11. To be specific, the axles 11 are respectively arranged at a front side and rear side in the railcar longitudinal direction so as to sandwich a cross beam 31 and extend in the railcar width direction. Each of the axles 11 extends such that end portions thereof are respectively located outside the wheels 10 in the left-right direction. The end portions of the axle 11 are respectively, rotatably supported by bearings 12. The bogie 100 according to the present embodiment is a so-called trailing bogie and does not include a driving device. However, in the case of an electric bogie, an electric motor is attached to the cross beam 31, and an output shaft of the electric motor and the axle 11 are connected to each other via a gear box.

The axle box portions 20 are members each configured to accommodate the bearing 12. Each of the axle box portions 20 includes an axle box main body 21, an axle beam 22, and a spring seat 23, and the axle box main body 21 accommodates the bearing 12. The configurations of the axle beam 22 and the spring seat 23 are as below.

The axle beam 22 is a member extending from the axle box main body 21 toward a front-rear direction middle side. To be specific, the axle beams 22 of the right front and left front axle box portions 20 extend in a rear direction, and the axle beams 22 of the right rear and left rear axle box portions 20 extend in a front direction. As shown in a left portion (cutaway portion) on the sheet of FIG. 2, a tubular portion 24 extending in the left-right direction is formed at a tip end of the axle beam 22, and a tubular rubber bushing 25 that is an elastic member is inserted in the tubular portion 24. A below-described core rod 37 is inserted in the rubber bushing 25.

Figure 3:
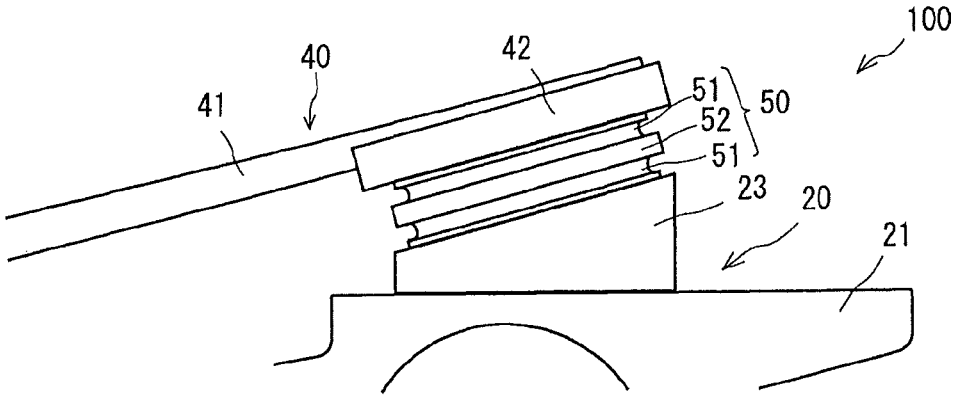
FIG. 3 is an enlarged view of the periphery of a spring seat of the bogie shown in FIG. 1.
Figure 4:
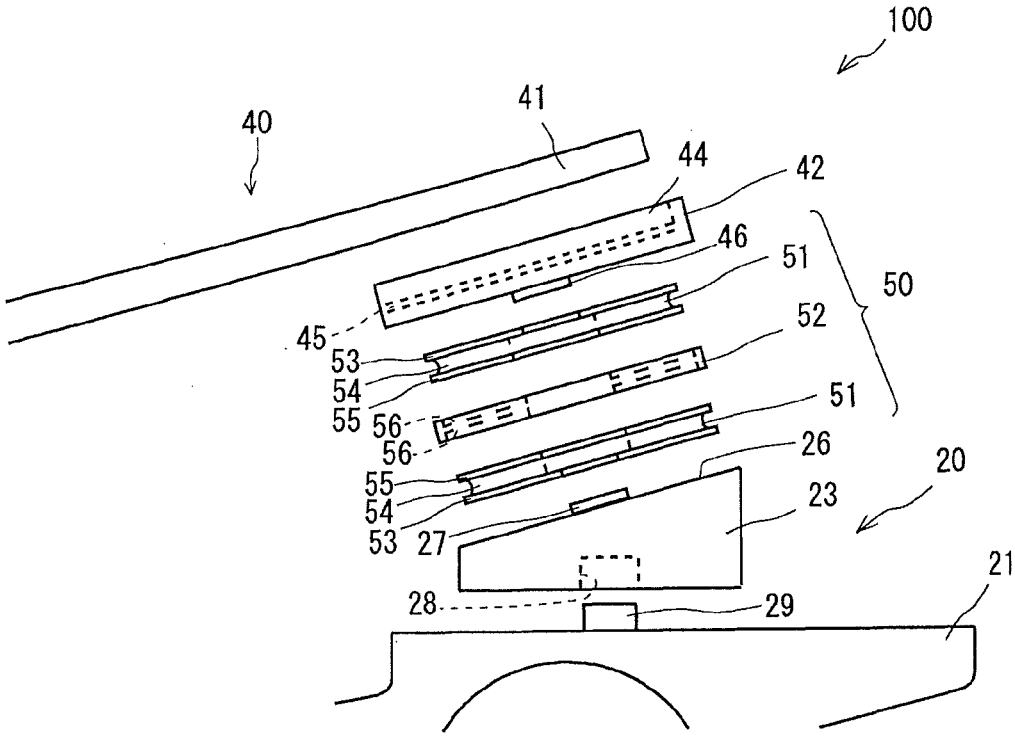
FIG. 4 is an exploded view of the portion shown in FIG. 3.

The spring seat 23 is a member arranged on an upper surface of the axle box main body 21. FIG. 3 is an enlarged view of the periphery of the spring seat 23 located at the left rear side, and FIG. 4 is an exploded view of the portion shown in FIG. 3. The spring seat 23 includes a supporting surface 26 that supports the plate spring portion 40. The supporting surface 26 is inclined toward a longitudinal direction middle portion of the plate spring portion 40. To be specific, the supporting surfaces 26 of the right front and left front spring seats 23 are inclined so as to face an upper rear side, and the supporting surfaces 26 of the right rear and left rear spring seats 23 are inclined so as to face an upper front side. As shown in FIG. 4, a columnar insertion piece 27 is formed on the supporting surface 26. An insertion hole 28 is formed on a lower surface of the spring seat 23, and an insertion projection 29 is formed on the upper surface of the axle box main body 21. By inserting the insertion projection 29 into the insertion hole 28, the spring seat 23 is fixed to the upper surface of the axle box main body 21. The axle box main body 21 and the spring seat 23 are configured as separate parts. However, the present embodiment is not limited to this, and the axle box main body 21 and the spring seat 23 may be configured integrally.

The cross beam portion 30 is a member configured to support a carbody, not shown. The cross beam portion 30 of the present embodiment includes the cross beam 31 and receiving seats 32.

The cross beam 31 is a member extending through a railcar width direction middle portion of the bogie 100 in the left-right direction. As shown in FIGS. 1 and 2, the cross beam 31 is mainly constituted by a pair of square pipes 33 and a plurality of connection members 34. The square pipes 33 are members extending in the left-right direction and made of metal. The connection members 34 are members configured to couple the square pipes 33 to each other and made of metal. Two connection members 34 are provided at each of left and right end portions of the square pipe 33, so that four connection members 34 are provided in total. Each of the connection members 34 extends in the front-rear direction and has an inverted U-shaped cross section. Air springs 36 that are secondary suspensions are attached to upper surfaces of the connection members 34 via air spring seats 35. The cross beam 31 supports a carbody 101 via the air springs 36.

The receiving seats 32 are plate-shaped members arranged in the vicinities of both left and right ends of the square pipes 33. As shown in FIG. 2, a pair of receiving seats 32 are arranged at each of the left and right ends of the square pipe 33 so as to be opposed to each other. The pair of receiving seats 32 are coupled to each other and are strongly fixed to the square pipes 33. One columnar core rod 37 is fixed to the front end portions of the pair of receiving seats 32 so as to extend between the receiving seats 32 as shown in a lower left portion on the sheet of FIG. 2, and another columnar core rod 37 is fixed to the rear end portions of the pair of receiving seats 32 so as to extend between the receiving seats 32. Then, as described above, the core rod 37 is being inserted into the rubber bushing 25 in the tubular portion 24. To be specific, the axle box portions 20 are coupled to the cross beam portion 30 (cross beam 31) via the rubber bushings 25 that are elastic members. With this, the axle box portions 20 are movable relative to the cross beam portion 30.

Each of the plate spring portions 40 includes a plate spring 41 and plate spring receiving portions 42.

The plate spring 41 is a member that serves as both a conventional coil spring (primary suspension) and a side sill. The plate spring 41 extends in the front-rear direction and is arranged at each of left and right sides of the cross beam portion 30. More specifically, the left plate spring 41 is arranged so as to extend between the left front axle box portion 20 and the left rear axle box portion 20, and the right plate spring 41 is arranged so as to extend between the right front axle box portion 20 and the right rear axle box portion 20. The plate spring 41 is formed in a bow shape that is convex downward in a side view. The plate spring 41 supports the cross beam portion 30 via a contact member 43 having a lower surface formed in a circular-arc shape. A material of the plate spring 41 is not especially limited. For example, a composite material constituted by a lower layer portion made of fiber-reinforced resin and an upper layer portion made of a thin metal may be used. A front-rear direction middle portion of the plate spring 41 is formed so as to be thicker than each of both front-rear direction end portions thereof.

The plate spring receiving portions 42 are members respectively arranged at both front-rear direction end portions of the plate spring 41 to support the plate spring 41. As shown in FIG. 2, each of the plate spring receiving portions 42 has a substantially rectangular shape in plan view, and a protective wall 44 is formed at three sides of the substantially rectangular shape, that is, a left side, right side, and front-rear direction outer side of the rectangular shape. The plate spring receiving portion 42 is made of metal. However, as shown in FIG. 4, a rubber sheet 45 is provided at a portion of the plate spring receiving portion 42, the portion being surrounded by the protective wall 44, and the plate spring 41 is supported by the plate spring receiving portions 42 via the rubber sheets 45. A columnar insertion piece 46 is formed on a lower surface of the plate spring receiving portion 42.

The gap bodies 50 are members each provided between the plate spring portion 40 and the axle box portion 20. As shown in FIG. 4, the gap body 50 is mainly constituted by elastic plates 51 and a rubber seat 52.

The elastic plates 51 are members respectively provided at an upper surface side and lower surface side of the gap body 50. Each of the elastic plates 51 is constituted by stacking a first metal plate 53, a rubber layer 54, and a second metal plate 55, each of which has an annular shape. Since the rubber layer 54 elastically deforms, the first metal plate 53 and the second metal plate 55 can be displaced parallel to each other. In the elastic plate 51 provided at the upper surface side, the first metal plate 53 is stacked at an upper side, and the second metal plate 55 is stacked at a lower side. In the elastic plate 51 provided at the lower surface side, the first metal plate 53 is stacked at the lower side, and the second metal plate 55 is stacked at the upper side. An inner diameter of the first metal plate 53 coincides with each of a diameter of the insertion piece 27 formed on the spring seat 23 and a diameter of the insertion piece 46 formed on the lower surface of the plate spring receiving portion 42. Therefore, by respectively inserting the insertion pieces 27 and 46 into the insides of the first metal plates 53, the elastic plates 51 can be respectively fixed to the spring seat 23 and the plate spring receiving portion 42.

The rubber seat 52 is a member provided between the elastic plates 51. The rubber seat 52 has a disc shape, and circular grooves 56 are respectively formed on both surfaces of the rubber seat 52. The inner diameter and outer diameter of the circular groove 56 respectively coincide with the inner diameter and outer diameter of the second metal plate 55. The elastic plates 51 can be fixed to the rubber seat 52 in such a manner that the second metal plates 55 of the elastic plates 51 are respectively fitted in the circular grooves 56 respectively formed on both surfaces of the rubber seat 52. As described above, in the gap body 50, respective components are fixed to one another by the fitting. Therefore, the gap body 50 does not fall apart between the plate spring portion 40 and the axle box portion 20. Since the gap body 50 elastically deforms, the plate spring portion 40 and the axle box portion 20 are relatively movable. In the present embodiment, the gap body 50 is constituted by a plurality of members (the elastic plates 51 and the rubber seat 52) but may be formed integrally.

Figure 5:
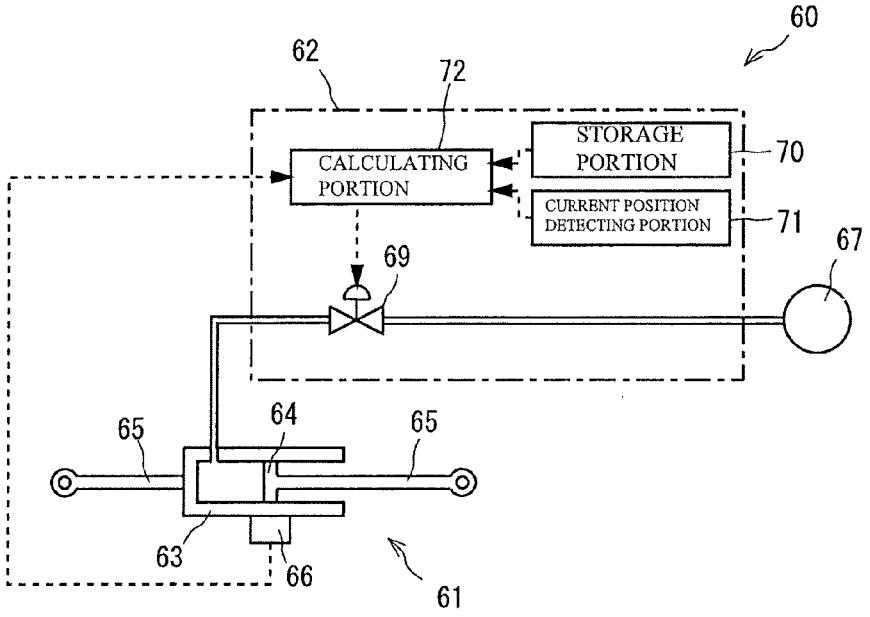
FIG. 5 is a block diagram of a steering device of the bogie according to Embodiment 1.

The steering device 60 is a device configured to change a wheel base that is a distance between the axles 11 in accordance with a curved track through which the bogie 100 travels, to change a steering angle. FIG. 5 is a block diagram of the steering device 60. As shown in FIG. 5, the steering device 60 includes driving portions 61 and a control portion 62. In FIGS. 1 and 2, only the driving portions 61 of the steering device 60 are shown.

As shown in FIG. 5, each of the driving portions 61 is mainly constituted by a cylinder 63, a piston 64, two coupling shafts 65, and a piston position detecting portion 66. Oil pressure is supplied from the oil-pressure pump 67 to the inside of the cylinder 63 by a command from the control portion 62, and the piston 64 moves by changing this oil pressure. As described below, the displacement amount of the piston 64 is determined based on a result calculated by a calculating portion 72. First ends of the coupling shafts 65 are respectively attached to coupling pieces 68 of the axle box main bodies 21, and one of second ends of the coupling shafts 65 is fixed to the cylinder 63 whereas another second end is fixed to the piston 64. The piston position detecting portion 66 feeds information regarding the position of the piston 64 back to the control portion 62. Then, as shown in FIG. 2, the driving portions 61 are respectively arranged at both left and right sides of the bogie 100.

The control portion 62 is mainly constituted by: a control valve 69 configured to adjust the oil pressure supplied to the piston 64; a storage portion 70 configured to store railway track information, such as a curvature of the curved track, a bending direction of the curved track, a start position and end position of the curved line, and a cant amount; a current position detecting portion 71 configured to detect a current position of the railcar; and the calculating portion 72. The calculating portion 72 can obtain information regarding the current position of the railcar from the current position detecting portion 71, information regarding the curvature of the curved track at the current position from the storage portion 70, and information regarding the position of the piston 64 from the above-described piston position detecting portion 66. Further, the calculating portion 72 can transmit a control signal to the control valve 69 to adjust the opening degree of the control valve 69. A specific control method by the control portion 62 will be described below.

Next, operations of the bogie 100 according to the present embodiment will be explained. The bogie 100 according to the present embodiment is steered by two methods. One is a steering method utilizing centrifugal force, and the other is a steering method performed by the steering device 60. The following will explain the operations of the bogie 100 by these two steering methods in order.

The steering method utilizing the centrifugal force is performed on the basis that the supporting surfaces 26 of the axle box portions 20 are being inclined. When the railcar travels through the curved line, a force acts on an upper surface of the plate spring portion 40 located at an outside rail side by the centrifugal force, and a force applied to each of the supporting surfaces 26 of the axle box portions 20 arranged in the railcar front-rear direction increases. As described above, since the supporting surfaces 26 are inclined toward the longitudinal direction middle portion of the plate spring portion 40, a component of force applied to the axle box portion 20 in a direction away from the middle of the plate spring portion 40, that is, in a direction toward a horizontally outer direction increases. With this, since the axle box portions 20 are coupled to the cross beam 31 via the rubber bushings 25, the wheel base at the outside rail side becomes longer than the wheel base at the inside rail side. Specifically, the distance between one of the axle box portions 20 and the cross beam 31 increases by about 6 mm, so that the wheel base increases by about 12 mm.

On the other hand, a force acting on the upper surface of the plate spring portion 40 located at the inside rail side decreases, and the wheel base at the inside rail side changes little or slightly decreases. With this, the steering angles of the front and rear axles 11 change such that extended lines of the front and rear axles 11 get close to the center of curvature of the curved track. As a result, the railcar can travel through the curved track efficiently with low resistance. As above, in a case where the downward force acts on the plate spring portion 40, the force in the railcar front-rear direction is generated by the inclination of the supporting surfaces 26 of the axle box portions 20, so that the wheel base at the outside rail side can be increased. Therefore, the curved line traveling performance can be improved by a simple configuration.

The steering method by the steering device 60 is performed based on the information regarding the current position of the railcar. First, the calculating portion 72 obtains the information regarding the current position of the railcar detected by the current position detecting portion 71 and obtains from the storage portion 70 the railway track information regarding the curved track through which the railcar is about to travel. Next, the calculating portion 72 calculates an optimum steering angle (hereinafter referred to as an "optimum angle") of each axle in accordance with the curvature. Then, the calculating portion 72 obtains the position of the piston 64 from the piston position detecting portion 66 based on the track information and calculates a current angle (hereinafter referred to as a "current angle") of each axle 11 based on the position of the piston 64. After that, in order that the current angle coincides with the optimum angle, the calculating portion 72 controls the control valve 69 to activate the driving portion 61, thereby displacing the piston 64. Thus, the wheel base of the wheels 10 arranged in the front-rear direction is changed. When the railcar travels through the curved line, the pressure in the cylinder 63 located at the outside rail side is increased, and the pressure in the cylinder 63 located at the inside rail side is decreased. With this, the steering angles of the axles 11 become appropriate, and the railcar can efficiently travel through the curved track.

In the present embodiment, the steering method utilizing the centrifugal force and the steering method by the steering device are being performed simultaneously. These steering methods can be performed separately. The steering method utilizing the centrifugal force can improve the curved line traveling performance by a simple configuration, and the steering method utilizing the steering device can improve the responsiveness.

Embodiment 2

Figure 6:
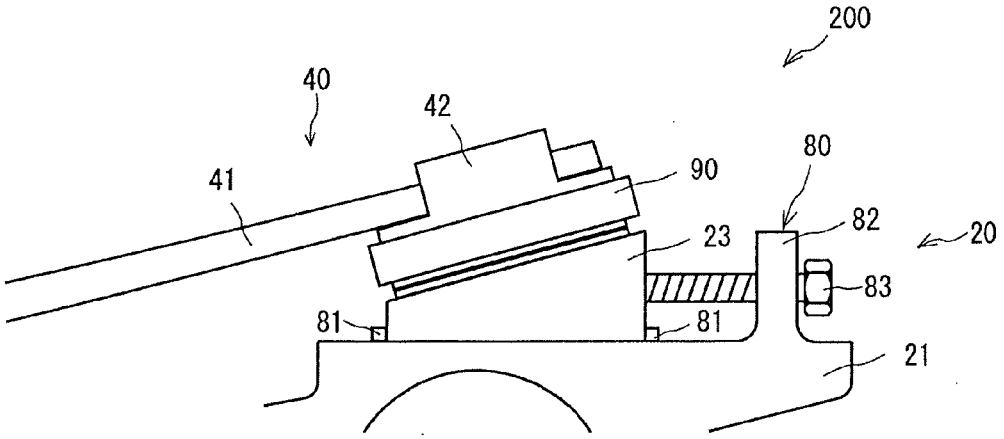
FIG. 6 is an enlarged view of the periphery of the spring seat of the bogie according to Embodiment 2.
Figure 7:
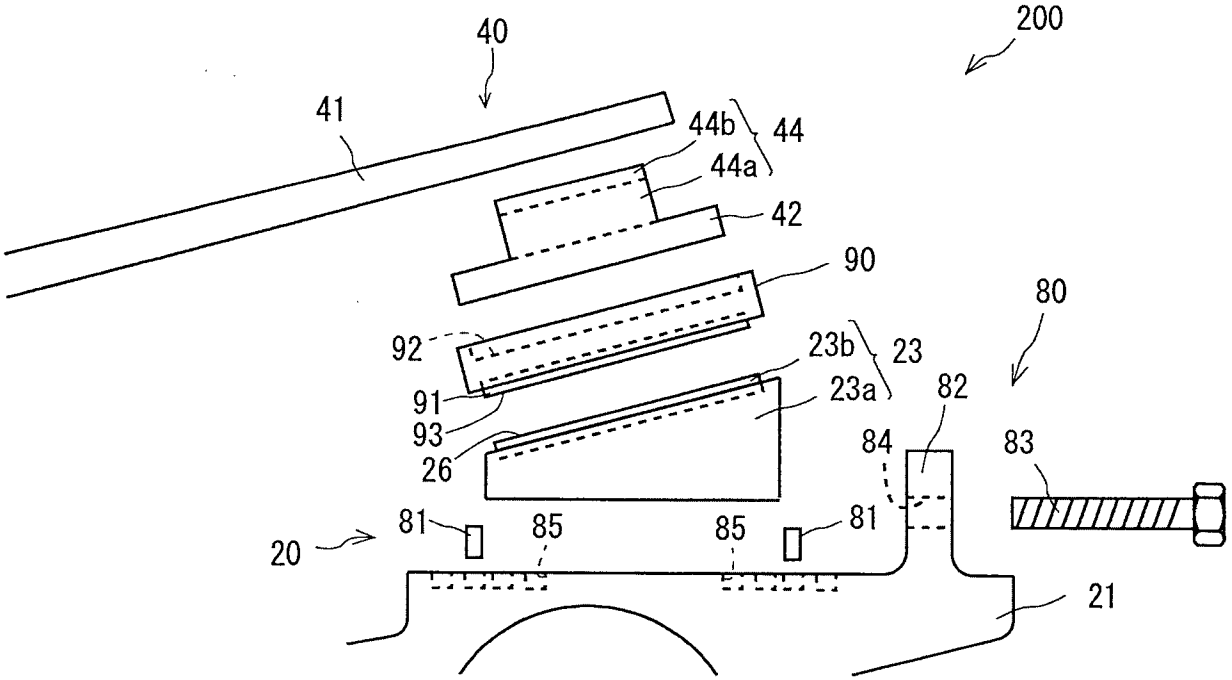
FIG. 7 is an exploded view of the portion shown in FIG. 6.

Next, a bogie 200 according to Embodiment 2 will be explained in reference to FIGS. 6 and 7. FIG. 6 is an enlarged view of the periphery of the spring seat 23 located at the left rear side, and FIG. 7 is an exploded view of the portion shown in FIG. 6. As shown in FIGS. 6 and 7, the bogie 200 according to the present embodiment does not include the gap bodies 50 (see FIG. 4), and the axle box portions 20 and the plate spring portions 40 herein are different in configuration from those in Embodiment 1. Components herein other than the above are basically the same as those in Embodiment 1. Hereinafter, the configurations of the axle box portion 20 and the plate spring portion 40 in the present embodiment will be explained in order.

Each of the axle box portions 20 of the present embodiment includes the axle box main body 21, the axle beam 22, the spring seat 23, a position adjusting portion 80, and positioning members 81. The axle box main body 21 and the axle beam 22 herein are basically the same as those in Embodiment 1. The configurations of the spring seat 23, the position adjusting portion 80, and the positioning member 81 are as below.

The spring seat 23 of the present embodiment is mainly constituted by a spring seat main body 23*a* and a sliding plate 23*b*. An upper surface of the spring seat main body 23*a* is inclined, and the sliding plate 23*b* is fixed to the upper surface of the spring seat main body 23*a*. The sliding plate 23*b* is a plate-shaped member made of metal and includes the supporting surface 26 that supports the plate spring portion 40. The supporting surface 26 is inclined so as to face an upper side of a middle portion of the plate spring portion. How to fix the sliding plate 23*b* to the spring seat main body 23*a* is not especially limited, but the sliding plate 23*b* may be fixed to the spring seat main body 23*a* by being fitted in the spring seat main body 23*a* or may be fixed to the spring seat main body 23*a* by utilizing bolts. In the case of utilizing the bolts, to prevent the bolts from contacting a sliding plate 91 of a below-described plate spring receiving portion holding member 90, for example, the sliding plate 91 needs to be partially cut out. Unlike Embodiment 1, the spring seat 23 is not directly fixed to the upper surface of the axle box main body 21 and is movable on the upper surface of the axle box main body 21 by detaching the below-described positioning members 81.

The position adjusting portion 80 is a portion configured to adjust a front-rear position of the spring seat 23 to adjust a load applied to the wheel 10. The position adjusting portion 80 is mainly constituted by a fixed portion 82 and a push-in member 83. The fixed portion 82 is formed so as to extend upward from a front-rear direction outer portion of the axle box main body 21. A screw hole 84 extending in the front-rear direction is formed at the fixed portion 82, and the push-in member 83 is screwed into the screw hole 84. The push-in member 83 is a bolt-shaped screw member. When the push-in member 83 is screwed into the screw hole 84 of the fixed portion 82, a tip end thereof contacts the spring seat 23. In this state, when the push-in member 83 is further screwed into the screw hole 84, the spring seat 23 can be caused to move to an inner side in the front-rear direction. As described above, the supporting surface 26 of the spring seat 23 is being inclined. Therefore, when the spring seat 23 moves to the inner side in the front-rear direction, a portion of the plate spring portion 40 moves upward, the portion contacting the supporting surface 26.

For example, when the spring seat 23 located at the left rear side is caused to move to the front side, a rear portion of the plate spring portion 40 located at the left side moves upward. To be specific, the rear portion of the plate spring portion 40 located at the left side supports the cross beam portion 30 (that is, the carbody 101) at a position higher than before. With this, a load higher than before is applied to the left rear wheel 10 corresponding to the rear portion of the plate spring portion 40 located at the left side. When operating the bogie 200, the load needs to be adjusted so as to be equally applied to the wheels 10. In the present embodiment, the load applied to each wheel 10 can be easily adjusted by the position adjusting portion 80 having a simple configuration.

The positioning members 81 are members configured to prevent the spring seat 23 from moving in the front-rear direction. The positioning members 81 of the present embodiment are columnar pins made of metal and are arranged in the vicinities of a front end and rear end of the spring seat 23. A plurality of positioning holes 85 into which the positioning members 81 can be inserted are formed on the upper surface of the axle box main body 21 so as to be lined up in the front-rear direction. The depth of the positioning hole 85 is about half the length of the positioning member 81. Therefore, in a state where the positioning member 81 is being inserted into the positioning hole 85, an upper half portion of the positioning member 81 projects from the upper surface of the axle box main body 21. As described above, the spring seat 23 is configured to be movable to an appropriate position in the front-rear direction. After the spring seat 23 is moved, the positioning members 81 are inserted into the positioning holes 85 located outside the spring seat 23 and closest to the spring seat 23. With this, the spring seat 23 can be held at the appropriate position.

The plate spring portion 40 of the present embodiment includes the plate spring 41, the plate spring receiving portions 42, and the plate spring receiving portion holding members 90. The plate spring 41 herein is the same as that in Embodiment 1.

A protective wall 44 is not formed at a front-rear direction outer side of the plate spring receiving portion 42 of the present embodiment, and the protective wall 44 is formed only at each of a middle portion of the left side of the plate spring receiving portion 42 and a middle portion of the right side of the plate spring receiving portion 42. Each of the protective walls 44 is constituted by: a vertical portion 44*a* extending upward; and a horizontal portion 44*b* horizontally extending from a tip end of the vertical portion 44*a* toward a left-right direction inner side of the plate spring receiving portion 42. The protective wall 44 has an inverted L shape as a whole. As shown in FIG. 6, the plate spring 41 is provided so as to be surrounded by the protective walls 44. The plate spring receiving portion 42 may be made of rubber or may be configured such that the entire plate spring receiving portion 42 is made of metal, and a rubber plate is attached to a part of the plate spring receiving portion 42, the part contacting the plate spring 41.

The plate spring receiving portion holding member 90 is a member configured to hold the plate spring receiving portion 42. A depression 92 having a shape corresponding to the shape of the lower surface of the plate spring receiving portion 42 is formed on an upper surface of the plate spring receiving portion holding member 90, and the plate spring receiving portion 42 is fitted in the depression 92. With this, the plate spring receiving portion 42 is held by the plate spring receiving portion holding member 90. The sliding plate 91 is being attached to the lower surface of the plate spring receiving portion holding member 90. The sliding plate 91 is a plate-shaped member made of metal and includes a contact surface 93 contacting the sliding plate 23*b* of the spring seat 23.

As with Embodiment 1, in the present embodiment, the railcar is steered by changing the distance between the wheels 10 lined up in the front-rear direction. The bogie 200 according to the present embodiment is not configured such that as in Embodiment 1, the plate spring portion 40 and the axle box portion 20 are coupled to each other via the gap body 50. Instead, the sliding plate 23*b* of the plate spring portion 40 and the sliding plate 91 of the axle box portion 20 can slide on each other. Therefore, the present embodiment can deal with the change in the distance between the wheels 10.

Each of the bogies explained above includes: a cross beam configured to support a carbody of a railcar; wheels arranged at both railcar width direction sides of the bogie to be lined up in a railcar longitudinal direction at each of the sides; a pair of front and rear axles between which the cross beam is located and which are respectively arranged at a front side and rear side in the railcar longitudinal direction so as to extend in a railcar width direction, each of the axles connecting the wheels located at a left side and right side in the railcar width direction; bearings arranged at both railcar width direction sides of each of the axles and configured to rotatably support the axle; axle box portions coupled to the cross beam via elastic members and each configured to store the bearing; and plate spring portions extending in the railcar longitudinal direction so as to respectively support both railcar width direction end portions of the cross beam, both railcar longitudinal direction end portions of each of the plate spring portions being respectively supported by the axle box portions, wherein each of the axle box portions includes a supporting surface that supports the plate spring portion such that the plate spring portion is relatively movable and that is inclined toward a longitudinal direction middle portion of the plate spring portion.

With this configuration, when the railcar travels through the curved track, a high force is applied to the plate spring portion located at the outside rail side, so that the wheel base at the outside rail side can be increased. As a result, the axle is inclined, and the steering can be performed. According to the steering method utilizing the centrifugal force, the curved line traveling performance can be improved by a simple configuration. In addition, the above configuration can deal with the change in the distance between the wheels arranged in the front-rear direction.

The bogie according to Embodiment 1 further includes gap bodies each configured to couple the supporting surface to the plate spring portion and be elastically deformable. Therefore, after the railcar has traveled through the curved track, the plate spring portions can naturally return to the original positions by the restoring forces of the gap bodies.

In the bogie according to Embodiment 2, the supporting surface and the plate spring portion are slidable on each other. Therefore, the wheel base can be changed more smoothly.

The above-described bogie further includes position adjusting portions each configured to cause the supporting surface to move in the railcar longitudinal direction. Therefore, the load applied to each wheel can be easily adjusted.

The foregoing has explained the embodiments in reference to the drawings. However, specific configurations are not limited to these embodiments. Design changes and the like within the scope of the present invention are included in the present invention. For example, the foregoing has explained a case where the supporting surface of the axle box portion is a flat surface, but the supporting surface may be a curved surface.

In the present embodiment, the driving portion 61 is driven by the oil pressure. However, the driving portion 61 may be driven by a ball screw of an electric motor using electric power or by an air compressor using air.

INDUSTRIAL APPLICABILITY

The present invention can provide a railcar bogie that is light in weight and has a steering function, and a railcar including the bogie. Therefore, the present invention is useful in the technical field of railcars.

REFERENCE SIGNS LIST

10 wheel
11 axle
12 bearing
20 axle box portion

25 rubber bushing (elastic member)
26 supporting surface
30 cross beam portion
31 cross beam
40 plate spring portion
41 plate spring
50 gap body
80 position adjusting portion
100 bogie
101 carbody

The invention claimed is:

1. A railcar bogie comprising:

a cross beam configured to support a carbody of a railcar, the cross beam extending in a rail car width direction;

wheels arranged at both railcar width direction sides of the bogie to be lined up in a railcar longitudinal direction at each of the sides;

a pair of front and rear axles between which the cross beam is located and which are respectively arranged at a front side and rear side in the railcar longitudinal direction so as to extend in the railcar width direction, each of the axles connecting the wheels located at a left side and right side in the railcar width direction;

bearings arranged at both railcar width direction sides of each of the axles and configured to rotatably support the axle;

axle boxes coupled to the cross beam via elastic members such that the axle boxes are movable relative to the cross beam, and each axle box being configured to store the bearing; and plate springs extending in the railcar longitudinal direction so as to respectively support both railcar width direction end portions of the cross beam, both railcar longitudinal direction end portions of each of the plate springs being respectively supported by the axle boxes, wherein each of the axle boxes includes a supporting surface that supports the plate spring such that the plate spring is relatively movable, and the supporting surface is inclined toward a longitudinal direction middle portion of the plate springs.

2. The railcar bogie according to claim 1, further comprising gap bodies each configured to couple the supporting surface to the plate spring and be elastically deformable.

3. The railcar bogie according to claim 1, wherein the plate spring is slidable with respect to the supporting surface.

4. The railcar bogie according to claim 1, further comprising position adjusting portions each configured to cause the supporting surface to move in the railcar longitudinal direction.

5. The railcar bogie according to claim 1, further comprising:

coupling members extending in the railcar longitudinal direction and each including one end connected to the axle box; and driving portions to each of which the other ends of the coupling members are connected, the driving portions each being configured to cause the coupling member to be displaced in the railcar longitudinal direction based on prestored railway track information to change a wheel base between the axles.

6. The railcar bogie according to claim 5, further comprising:

a storage portion configured to store track curvature information of a traveling point of the railcar; and a position detecting portion configured to detect a current position of the railcar, wherein each of the driving portions changes a displacement amount of the coupling member based on the curvature information and the current position.

7. A railcar comprising the railcar bogie according to claim 1.

8. The railcar bogie according to claim 1, wherein the supporting surface is located above the bearing stored in the axle box.

9. The railcar bogie according to claim 1, wherein the elastic members are disposed between the axle boxes and the cross beam in the railcar longitudinal direction such that the axle boxes are movable relative to the cross beam.

* * * * *